US008100300B2

(12) United States Patent
DeJonge

(10) Patent No.: US 8,100,300 B2
(45) **Date of Patent: *Jan. 24, 2012**

(54) ROTATE, SQUEEZE AND LIFT CHILD RESISTANT SAFETY CAP WITH DISPENSING ACTUATOR

(75) Inventor: Stuart W. DeJonge, DeLand, FL (US)

(73) Assignee: DeJonge Associates, Inc., DeLand, FL (US)

( * ) Notice: Subject to any disclaimer, the term of this patent is extended or adjusted under 35 U.S.C. 154(b) by 52 days.

This patent is subject to a terminal disclaimer.

(21) Appl. No.: 12/653,565

(22) Filed: Dec. 16, 2009

(65) Prior Publication Data

US 2010/0096354 A1 Apr. 22, 2010

Related U.S. Application Data

(63) Continuation-in-part of application No. 12/082,317, filed on Apr. 10, 2008.

(51) Int. Cl.
*B67D 7/06* (2010.01)
*B65D 55/02* (2006.01)

(52) U.S. Cl. ..... 222/182; 222/179; 215/206; 215/220; 215/209; 215/221

(58) Field of Classification Search ..... 222/182, 222/179, 257, 45, 632, 635, 228, 494, 492, 222/402.1, 402, 402.13, 402.21; 215/218
See application file for complete search history.

(56) References Cited

U.S. PATENT DOCUMENTS 2,612,293 A * 9/1952 Michel ..... 222/182
2,767,888 A * 10/1956 Soffer ..... 222/182
2,856,104 A * 10/1958 Spiess, Jr. et al. ..... 222/402.25
2,877,936 A * 3/1959 Michel ..... 222/182
3,124,275 A * 3/1964 Lake ..... 222/182
3,637,109 A * 1/1972 Stifter ..... 221/310
3,831,801 A * 8/1974 Rodgers ..... 220/203.25
3,831,820 A * 8/1974 Focht ..... 222/182
4,020,981 A * 5/1977 Nixdorff ..... 222/525
4,080,441 A 3/1978 Gaffar et al.
4,162,746 A * 7/1979 Anderson et al. ..... 222/153.13
4,224,307 A 9/1980 Thiele et al.
4,472,373 A 9/1984 Ryan
4,901,891 A * 2/1990 Goncalves ..... 222/402.13
(Continued)

*Primary Examiner* — Anthony Stashick
*Assistant Examiner* — Kevin Castillo
(74) *Attorney, Agent, or Firm* — Kenneth P. Glynn, ESQ; Deirdra M. Meagher, ESQ

(57) ABSTRACT

A rotate, squeeze and lift child resistant safety cap with a dispenser actuator for attachment to a pressurized container having a dispenser stem on its top includes: an inner member for attachment to either the container or its closure, the inner member having an outer member interlocking component, being one of a circular track and a circular rail, the circular track having inside and outside ledges with a track space between the inside and outside ledges, the track space having a predetermined track space width, the circular rail having inside and outside protrusions adapted to ride inside the track space and under the ledges, the protrusions having widths less than the track space width and greater than one half the track space width; and an outer member being an outer closure having a circular bottom that is semi-flexible, and at its circular bottom, having the other of the one of a circular track and a circular rail. When a user squeezes the outer member at the squeeze indicia to flex the outer member from circular to oval, the outer member can be removed to expose the dispenser stem for use.

20 Claims, 11 Drawing Sheets

U.S. PATENT DOCUMENTS 4,988,017 A * 1/1991 Schrader et al. ..... 222/130
5,038,964 A * 8/1991 Bouix ..... 222/153.04
5,110,583 A 5/1992 Sampathkumar
5,305,918 A * 4/1994 D'Andrade ..... 222/78
5,356,043 A * 10/1994 Glynn ..... 222/153.04
5,509,580 A * 4/1996 Glynn ..... 222/153.1
5,584,420 A * 12/1996 Awada et al. ..... 222/153.09
5,765,601 A * 6/1998 Wells et al. ..... 141/38
5,849,311 A 12/1998 Sawan et al.
5,915,597 A * 6/1999 De Laforcade ..... 222/182
5,915,599 A * 6/1999 Takahashi ..... 222/402.13
6,065,648 A * 5/2000 Tauber ..... 222/153.14
6,126,931 A 10/2000 Sawan et al.
6,450,352 B1 9/2002 DeJonge
7,017,782 B2 * 3/2006 Harrold ..... 222/153.1
D537,714 S * 3/2007 Yerby et al. ..... D9/448
7,828,117 B2 * 11/2010 Cole ..... 182/33
2009/0255896 A1 * 10/2009 DeJonge ..... 215/206
2009/0277930 A1 * 11/2009 Carta ..... 222/153.01

* cited by examiner

ROTATE, SQUEEZE AND LIFT CHILD RESISTANT SAFETY CAP WITH DISPENSING ACTUATOR

REFERENCE TO RELATED PATENT APPLICATION

This application is a continuation in part of the copending U.S. patent application Ser. No. 12/082,317, filed on Apr. 10, 2008, by the same inventor as herein and entitled "ROTATE, SQUEEZE AND LIFT CHILD RESISTANT SAFETY CAP".

BACKGROUND OF INVENTION a. Field of Invention

The invention relates generally to a retrofitted child resistant safety cap that relies upon squeezing an outer member or inner member to flex it from a circle to an oval to permit removal or separation from one another to expose a dispenser actuator. Failure to position the thumb and first finger on the indicia and to squeeze, renders the safety cap child resistant. In some embodiments, there are indicia on both members and rotational alignment is required before proper squeezing to separate the two members from one another. In this invention, a dispenser actuator is physically connected to and hinges on one member of the cap.

b. Description of Related Art

The following patents are representative of the field pertaining to the present invention:

U.S. Pat. No. 6,450,352 B1 to DeJonge describes a present invention which is a child-resistant push and twist locking container. It includes a squeeze tube container having a neck and a dispensing orifice at an outer end of the neck, and the neck has one of a locking track and a locking lug. There is also a cap having at least three components and being assembled to cooperate with each other. This cap includes an outer shell having a sidewall and a top, the outer shell being adapted to receive and contain an inner top, a spring mechanism and an inner collar member; an inner top inserted into the outer shell and including a sealing liner for sealing the container and an inner collar member fixedly inserted into the outer shell and having the other of the locking track and the locking lug. There is a spring mechanism on at least one of the outer shell, the inner top and between the outer shell as a separate piece so as to permit the cap to be pushed and twisted into a closed side of the locking track wherein the spring mechanism biases the cap away from the container to maintain the lug in the track closed side.

U.S. Pat. No. 5,927,527 to Montgomery et al. describes a closure and container combination which comprises a child resistant squeeze and turn closure having a tamper indicating band which is removed from the closure after the first removal of the closure from the container. The closure has dual squeeze pads located opposite one another on the outer wall of the closure. Formed at 90 degrees from the squeeze pads are two child resistant lugs which extend inwardly from the closure lower skirt wall. The child resistant lugs extend downwardly below the lowermost edge of the annular skirt of the closure. Frangible webs are positioned at 45 degrees from the external tabs and the squeeze pads and retain the tamper indicating band onto the closure side wall. A first and a second child resistant container lug contacts the closure lugs and are placed on the neck of the container above the tamper indicating bead. The child resistant feature of the closure needs to be overcome before the tamper indicating band is fractured from the closure. After removal of the tamper indicating band, the child resistant lugs extend below the closure side wall to provide a visual cue as to the child protective feature of the closure.

U.S. Pat. No. 5,687,863 to Kusz describes a squeeze and turn child resistant package including a container having a finish and a closure having a base wall and an outer peripheral flexible wall depending from the base wall. The wall has an internal thread on the inner surface thereof, the finish has an external thread thereon. The closure has an internal surface with spaced flexible chordal lugs extending circumferentially in the direction of removal of the closure. The container finish has opposed radially extending abutments. Each abutment includes a radial abutting surface. The finish of the container includes an intergral radial projection adjacent the radial abutting surface of the abutment which has a lesser radial extent than the abutment. The radial projection has a chordal surface extending to the intersection of the radial abutting surface on the finish such that the chordal lug on the closure is forced toward the intersection when a closure is rotated in a retrograde direction to remove the closure without flexing the peripheral wall. The finish has stops below the threads engaging a blunt end leading end of the thread on the closure to limit the movement of the closure and orient the closure.

U.S. Pat. No. 4,452,363 to Davis describes an invention which provides a tamper-resistant and child-resistant container and cap assembly in which a container body with a substantially cylindrical neck including an externally screw threaded portion near to the top and a plurality of lugs at the bottom, a cap with a cap body which tapers internally outwardly from an internally screw-threaded part near to the top and which has a corresponding number of depending webs near to the bottom for engagement with the lugs of the container body in the manner of a ratchet and pawl mechanism and a tamper-resistant band provided below the cap body and connected thereto by frangible tongues, the band being shaped to engage with the container body so that when the cap is unscrewed the cap body rises but the band is held down and the frangible tongues are broken.

U.S. Pat. No. 4,004,704 to Fernand Hilaire discloses a tamper-proof plastic closure device with safety means comprising and internally screw-threaded plug matching the screw-threaded and beaded neck of a container. The plug is retained by the neck bead engaging a groove formed in the outer skirt of the plug and the plug itself is covered by a cap in smooth frictional contact therewith. The central area of the internal surface of the flexible and bulged top wall the cap which is bounded by a rigid projecting circular rib, comprising means adapted to co-act with matching means provided in the central area of the plug when a sufficient pressure is exerted on the area, so as to rotatably drive the plug and release same from the retaining bead.

U.S. Pat. No. 3,749,270 to Lyle Claud Affleck describes an arrangement, for closing a container such as a bottle or like container, including a cap within the skirt of which is mounted one or more projections, for example, pins. Each pin fits into a groove formed in or on the neck or similar formation on the container. Each groove has at least one indent within which the inserted pin can be located to hold the cap in a position to seal the container. The cap is provided with means to bias it away from the container when the latter is sealed, and an enlarged indented section within a groove is used so that the biasing action in combination with the enlarged indented section provide a closure for the container which cannot be easily undone by young children. In another arrangement, the pins are located on the container and the grooves within the cap.

U.S. Pat. No. 3,733,001 to Peter Gach discloses a container and child proof closure therefor. The container has a neck surrounding an opening. At least two flanges project from the neck. Each flange has a spirally expanding first camming surface and downwardly directed helilcal second camming surface which terminates at an inwardly directed end surface. The closure comprises outer and inner members. The outer member includes lugs for engaging the second camming surface as the cap is rotated on the container neck to a locked position for holding the closure on the neck. The inner member includes resilient means which ride of the first camming surfaces and abut the flange end when the closure is to the locked position to prevent removal of the closure. Movement of the inner closure member against spring means within the outer closure member permits the closure to be rotated from the locked position for removal from the container. In one embodiment, means is provided for further tightening the closure on the container after it is in the locked portion.

U.S. Pat. No. 3,339,770 to Bruno Weigand describes in combination with a container provided with a mouth portion: a cap having a cylindrical side wall applicable to the mouth portion container, circumferentially-spaced side lugs carried by the cap on the inside thereof, climbing cams carried by the mouth of the container and peripherally disposed thereon for engagement by said lugs when the cap is turned in the closing direction to draw the cap down, recess means for engagement by the lugs to preclude the cap from turning in the opening direction, and tensionable means depending from said side wall for securing the lugs in the recess means, said tensionable means including an annular extension member in the vicinity of said mouth portion in the applied position of the container, said extension member having a resilient wall portion disposed to extend alongside of said mouth with a free edge curved outwardly therefrom for spreading under tension by contact with a relatively fixed surface when the cap is turned in its closing direction.

Notwithstanding the prior art, the present invention is neither taught nor rendered obvious thereby.

SUMMARY OF INVENTION

The present invention is, in one important aspect, or first embodiment, a rotate, squeeze and lift child resistant safety cap with a dispenser actuator for attachment to a pressurized container having a dispenser stem on its top. In another important aspect, or second embodiment, the actuator member and the inner member are formed in a single mold to create an efficient unistructural piece that provides simultaneous alignments and assemblages both the actuator and the cap receiver (inner member). The present invention, thus, includes: a) an inner member having attachment mechanisms for attachment to a pressurized container having a container top with a dispenser or stem on the container top, the inner member having an outer member interlocking component, being one of a circular track and a circular rail, the circular track having inside and outside ledges with a track space between the inside and outside ledges, the track space having a predetermined track space width, the circular rail having inside and outside protrusions adapted to ride inside the track space and under the ledges, the protrusions having widths greater than one half the track space width; b) a dispenser actuator member having a base and a stem pipe, the stem pipe being adapted to fit over the dispenser stem of the pressurized container, the dispenser actuator member being hingedly attached to the inner member; c) an outer member being an outer closure having a circular bottom that is semi-flexible, and at its circular bottom, having the other of the one of a circular track and a circular rail, the circular track having inside and outside ledges with a track space between the inside and outside ledges, the track space having a predetermined track space width, the circular rail having inside and outside protrusions adapted to ride within the track space and under the ledges, the protrusions having widths greater than one half the track space width, and having squeeze indicia above the outside protrusions, the outer member having an open interior adapted to fit over the dispenser actuator member; wherein, when the inner member is attached to the pressurized container and the inner member and the outer member are interconnected, a user cannot lift the outer member from the inner member nor lift the inner member from the container so that access to the dispenser actuator members is denied, except, if a user squeezes the outer member at the squeeze indicia to flex the outer member from circular to oval, the outside protrusions will position inwardly to clear the ledges and the inside protrusions will position outwardly to clear the ledges so as to enable lift removal of the outer member from the inner member to expose dispenser actuator member for activation to dispense contents of the pressurized container.

In some preferred embodiments of the present invention rotate, squeeze and lift child resistant safety cap with a dispenser actuator for attachment to a pressurized container having a dispenser stem on its top, the dispenser actuator member includes a depression pad attached to at least one of the dispenser actuator member base and the dispenser actuator member dispenser stem.

In some preferred embodiments of the present invention rotate, squeeze and lift child resistant safety cap with a dispenser actuator for attachment to a pressurized container having a dispenser stem on its top, the inner member, the dispenser actuator member and the outer member are circular from a top view.

In some preferred embodiments of the present invention rotate, squeeze and lift child resistant safety cap with a dispenser actuator for attachment to a pressurized container having a dispenser stem on its top, there are two outside protrusions and two inside protrusions. In some preferred embodiments of the present invention rotate, squeeze and lift child resistant safety cap with a dispenser actuator for attachment to a pressurized container having a dispenser stem on its top, the protrusions are spaced equally apart from one another.

In some preferred embodiments of the present invention rotate, squeeze and lift child resistant safety cap with a dispenser actuator for attachment to a pressurized container having a dispenser stem on its top, the attachment mechanism is a riser and an inwardly projecting clamping component.

In some preferred embodiments of the present invention rotate, squeeze and lift child resistant safety cap with a dispenser actuator for attachment to a pressurized container having a dispenser stem on its top, one of the ledges includes cutouts corresponding to at least one of the inside protrusions and the outside protrusions and both the inner member and the outer member have alignment means for rotation and alignment with one another to align the cutouts with their corresponding protrusions so as to clear at least one but not all of the protrusions prior to squeezing for lifting the outer member from the inner member.

In some preferred embodiments of the present invention rotate, squeeze and lift child resistant safety cap with a dispenser actuator for attachment to a pressurized container having a dispenser stem on its top, the cutouts are located on the inside ledge and correspond to the inside protrusions. In other preferred embodiments of the present invention rotate, squeeze and lift child resistant safety cap with a dispenser actuator for attachment to a pressurized container having a dispenser stem on its top, the cutouts are located on the outside ledge and correspond to the outside protrusions.

In some preferred embodiments of the present invention rotate, squeeze and lift child resistant safety cap with a dispenser actuator for attachment to a pressurized container having a dispenser stem on its top, when the inner member is attached to a container under its conventional closure and the inner member and the outer member are interconnected, a user cannot lift the outer member from the inner member nor lift the inner member from the container so that access to the conventional closure is denied. However, if a user squeezes the inner member at the squeeze indicia to flex the inner member from circular to oval, the outside protrusions are positioned inwardly to clear the ledges and the inside protrusions are positioned outwardly to clear the ledges so as to enable lift removal of the outer member from the inner member to expose the dispenser actuator member.

The first concept of the invention involves squeezing either an inner member or an outer member to flex either the rail or the track to change its shape from a circle to an oval, so that there is relative movement between the track space and the rail protrusions to permit otherwise hindered removal of the outer member from the inner member to expose a conventional container closure for use. When one of the inner and outer members is properly squeezed, the outside protrusions are stated as positioned inwardly and conversely, the inside protrusions are stated as positioned outwardly. Thus, they are cleared from the confining ledges of the track. It should be noted, however, that the positioning may occur by squeezing one of the rail and the track and that actual movement may thus be either the track (ledge space) or the rail (protrusions) with the net result of the relative movement between the ledge space and the protrusions being the same. In other words it does not matter whether the protrusions are moved into the space or the space is moved to the protrusions—the relative positioning is the same.

The second concept of the invention involves providing a dispenser actuator that is built into the inner member. This creates easy one shot attachment of the two features—the inner member and the actuator, and does so with simultaneous alignment during assembly.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

INCORPORATION BY REFERENCE

The entire application known as U.S. patent application Ser. No. 12/082,317, filed on Apr. 10, 2008, entitled "Rotate, Squeeze and Lift Child Resistant Safety Cap" by the same inventor herein, is hereby incorporated into this present application by reference.

DETAILED DESCRIPTION OF THE EMBODIMENTS

Figure 1:
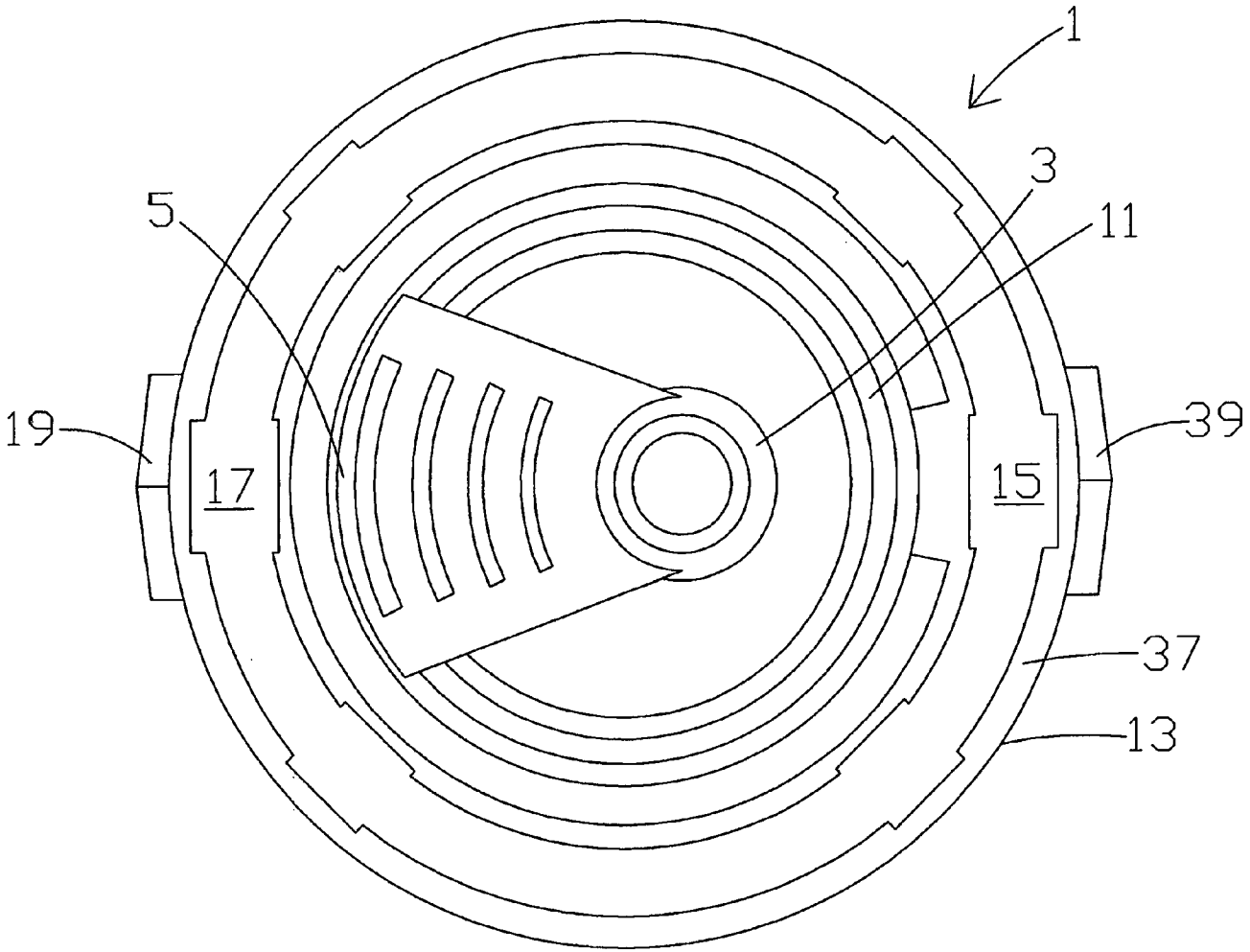
FIG. 1 shows a top view of a present invention squeeze and lift child resistant safety closure inner member.

FIG. 1 shows a top view of a present invention rotate, squeeze and lift child resistant safety cap inner member 1. Inner member 1 is circular when viewed from the top and in the present embodiment is unistructurally formed with the dispenser actuator 3. The dispenser actuator 3 is attached to the inner member 1 by hinge 11, which allows dispenser actuator 3 to tilt relative to inner member 1 when force is applied to the base 5.

Circular track 37 is visible near the perimeter of inner member 1 and allows for inner member 1 to be connected to an outer member (not shown) of the present invention as described below. Cutouts 15 and 17 in circular track 37 are adapted to only allow the inner member 1 to disconnect from an outer member when the inner member 1 and outer member (not shown) are properly aligned. To assist in achieving proper alignment, alignment means 19 and 39 are located on the side 13 of inner member 1.

Figure 2:
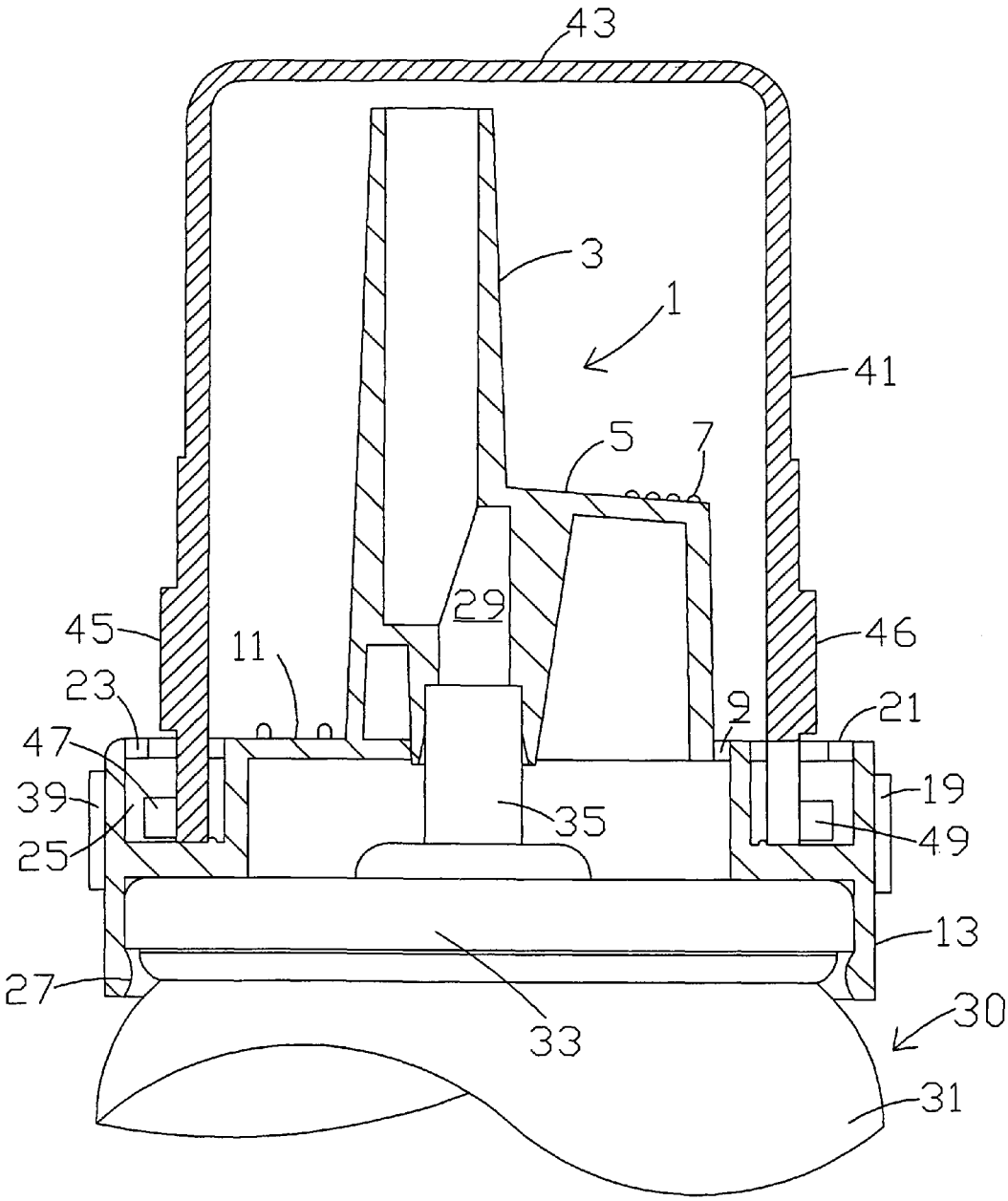
FIG. 2 shows a side cut view of a present invention squeeze and lift child resistant safety closure, including an inner member and an outer member, as well as a pressurized container.

FIG. 2 shows a side cut view of the present invention squeeze and lift child resistant safety cap 30, including an outer member 43 connected to an inner member 1 as described in FIG. 1, which is connected to a pressurized container 31.

Referring to FIG. 2 child resistant safety cap 30 has inner member 1 attached to a pressurized container 31. In the present embodiment, the inner member 1 is attached to the pressurized container 31 by an inner protrusion 27 on the side 13 of the inner member 1. The side 13 of inner member 1 is sized to fit over the chime 33 of the pressurized container 31 such that the protrusion 27 forms a force-fit between the inner member 1 and pressurized container 31. The pressurized container 31 has a dispenser stem 35 on the top of pressurized container 31 for dispensing, which may be a liquid, gel, spray, foam or powder.

A dispenser actuator member 3 is connected to inner member 1 to create a single unistructurally formed piece. The dispenser actuator member 3 has a base 5 and a stem pipe 29 being adapted to fit over the dispenser stem 35 of the pressurized container 31. A depression pad 7 is connected to the base 5 in the present invention. The dispenser actuator member 3 is hingedly attached to the inner member 1 by hinge 11 and air space 9. This permits dispenser actuator member 3 to tilt when pressure is applied to depression pad 7.

The outer member 43 is comprised of an outer closure 41 adapted to fit over the dispenser actuator member 3 of the inner member 1. The outside member 43 has a circular bottom that is semi-flexible and has a circular rail with outside protrusions 47 and 49 which are adapted to ride within the track space 25 and under the outer ledge 21 of the inner member 1. The protrusions 47 and 49 have widths greater than one half the track space 25 width. Although not show, inside protrusions may be used in addition to the outside protrusions 47 and 49 visible in FIG. 2. Outer member 43 has squeeze indicia 45 and 46 above the outside protrusions 47 and 49, which aid the user in properly squeezing outer member 43 when opening the child resistant safety cap 30.

There is a cutout 23 in outside ledge 21 to permit protrusions 47 and 49 to be inserted into track space 25 when aligned and squeezed as described below. Alignment means 19 and 39 are located on the side 13 of inner member 1. Alignment means 19 and 39 aid the user in aligning cutout 23 with the outside protrusions 47 and 49 of the outer member 43 when opening the child resistant safety cap 30.

When the inner member 1 is attached to the pressurized container 31 and the inner member 1 and the outer member 43 are interconnected, a user cannot lift the outer member 43 from the inner member 1 nor lift the inner member 1 from the pressurized container 31 to gain access to the dispenser actuator member 3. To access the dispenser actuator member 3 a user aligns outer member 43 and inner member 1 with the aid of the alignment means 19 and 39 and squeezes the outer member 1 at the squeeze indicia 45 and 46 to flex outer member 1 from circular to oval. This moves the outside protrusions 47 and 49 inwardly to clear the outside ledge 21 through cutout 23 so as to enable the user to lift and remove the outer member 43 from the inner member 1 to expose dispenser actuator member 3. (Congruently when outer protrusions 47 and 49 are moved inwardly by squeezing, the inward protrusions ellipse outwardly, allowing all protrusions to clear their cutouts.) The user can then dispense contents of the pressurized container 31, which may be a liquid, gel, spray, foam or powder by pressing down on depression pad 7 of the dispenser actuator member 3. This causes dispenser stem 35 to tilt and dispense the contents of the pressurized container 31 through stem pipe 29.

Figure 3:
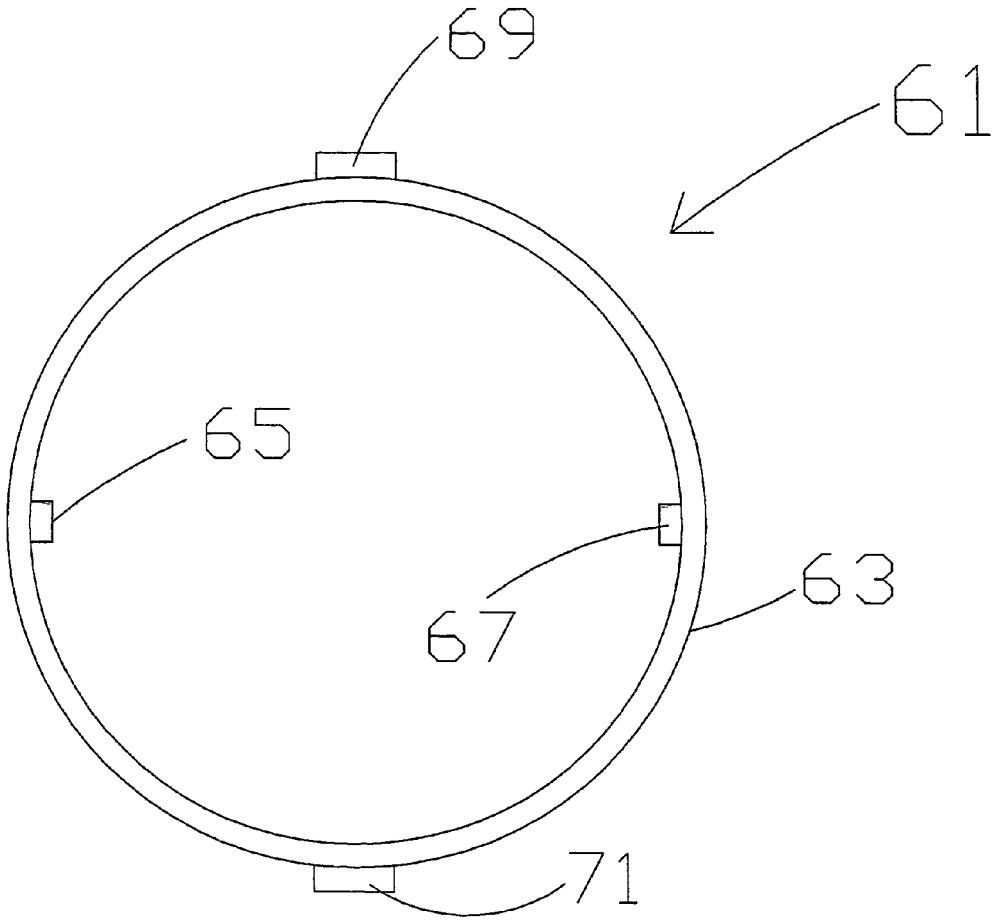
FIG. 3 shows a top view of a present invention squeeze and lift child resistant safety closure outer member that may be used in conjunction with, among others, the inner member shown in FIG. 1.

FIG. 3 shows a top view of a present invention squeeze and lift child resistant safety closure outer member 61 that may be used in conjunction with, among others, the inner member 1 shown in FIG. 1 above. Outer member 61 is shown with its top removed to reveal inside protrusions 65 and 67, along with outside protrusions 69 and 71 located on the rail 63.

Figure 4:
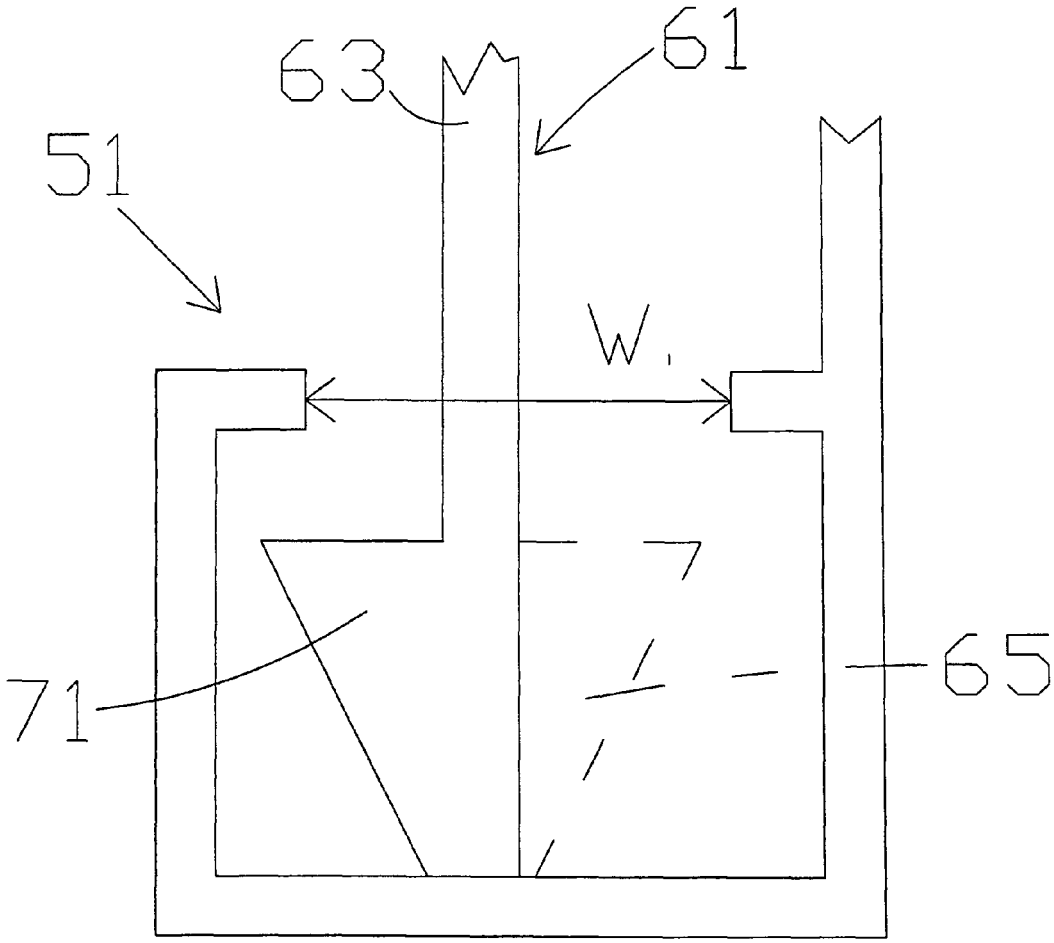
FIG. 4 shows a partial side cut view of the inner member with a partial cut side view of the outer member from to illustrate the relative widths of the track space and the rail protrusions.

FIG. 4 shows a partial side cut view of the inner member 51 with a partial cut side view of the outer member 61 from FIG. 3 to illustrate the relative widths of the track space and the protrusions 65 and 71 on rail 63. As FIG. 4 shows, inner member 51 has an opening with a width $W_1$ that is wider than the width of protrusions 65 and 71. In some preferred embodiments including the example shown in FIG. 4, rail protrusions 65 and 71 have a width greater than one half of the track space width $W_1$, but less than the track space width $W_1$.

Figure 5:
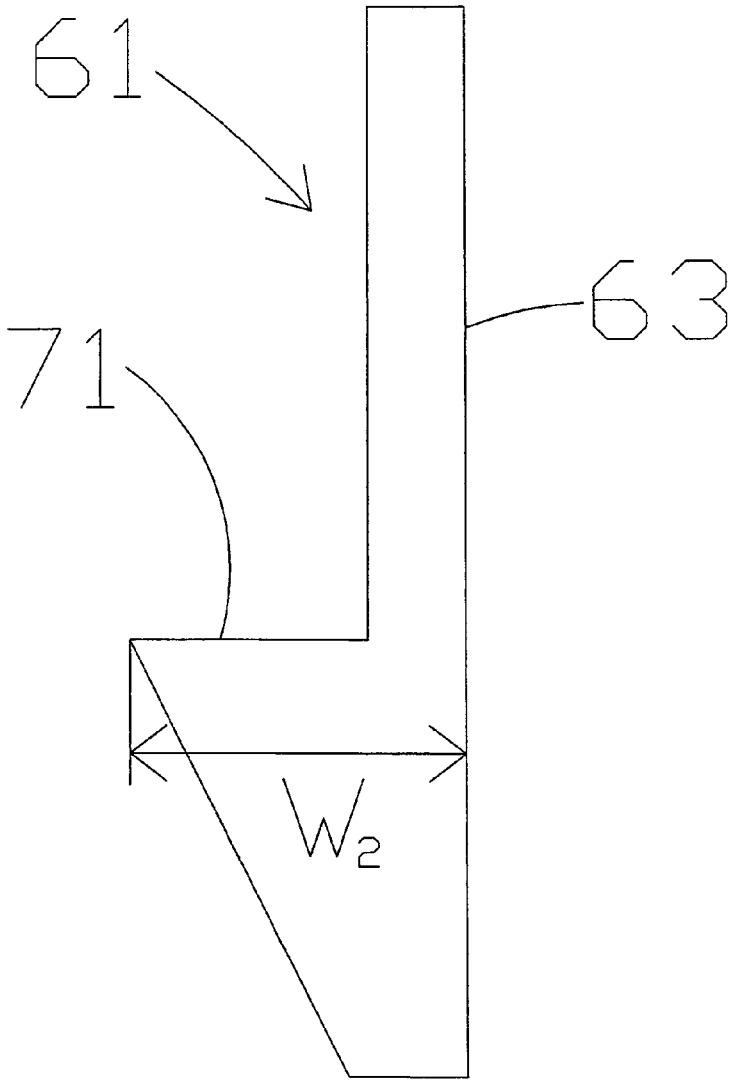
FIGS. 5 and 6 show partial cut side views of different parts of the present invention outer member.
Figure 6:
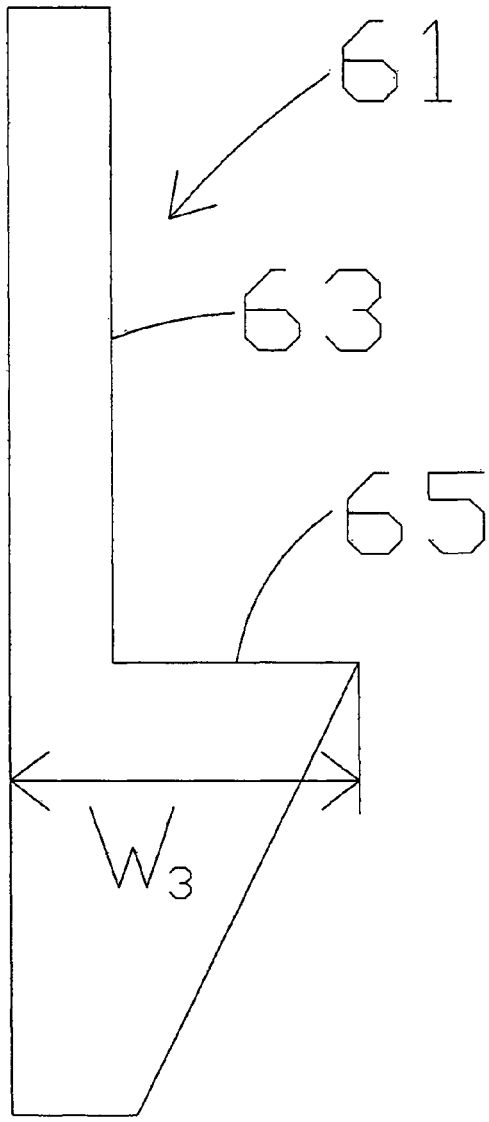

FIGS. 5 and 6 show partial cut side views of different parts of the present invention outer member 61 shown in FIG. 3. FIG. 5 shows outside protrusion 71 on rail 63 with a maximum width of $W_2$ and FIG. 6 shows inside protrusion 65 on rail 63 with a maximum width of $W_3$. In these embodiments $W_2$ and $W_3$ are each greater than one half of $W_1$, but less than $W_1$. These relationships enable the protrusions 65 and 71 to fit into the track space but then to not be able to be removed therefrom without squeezing distortion.

Figure 7:
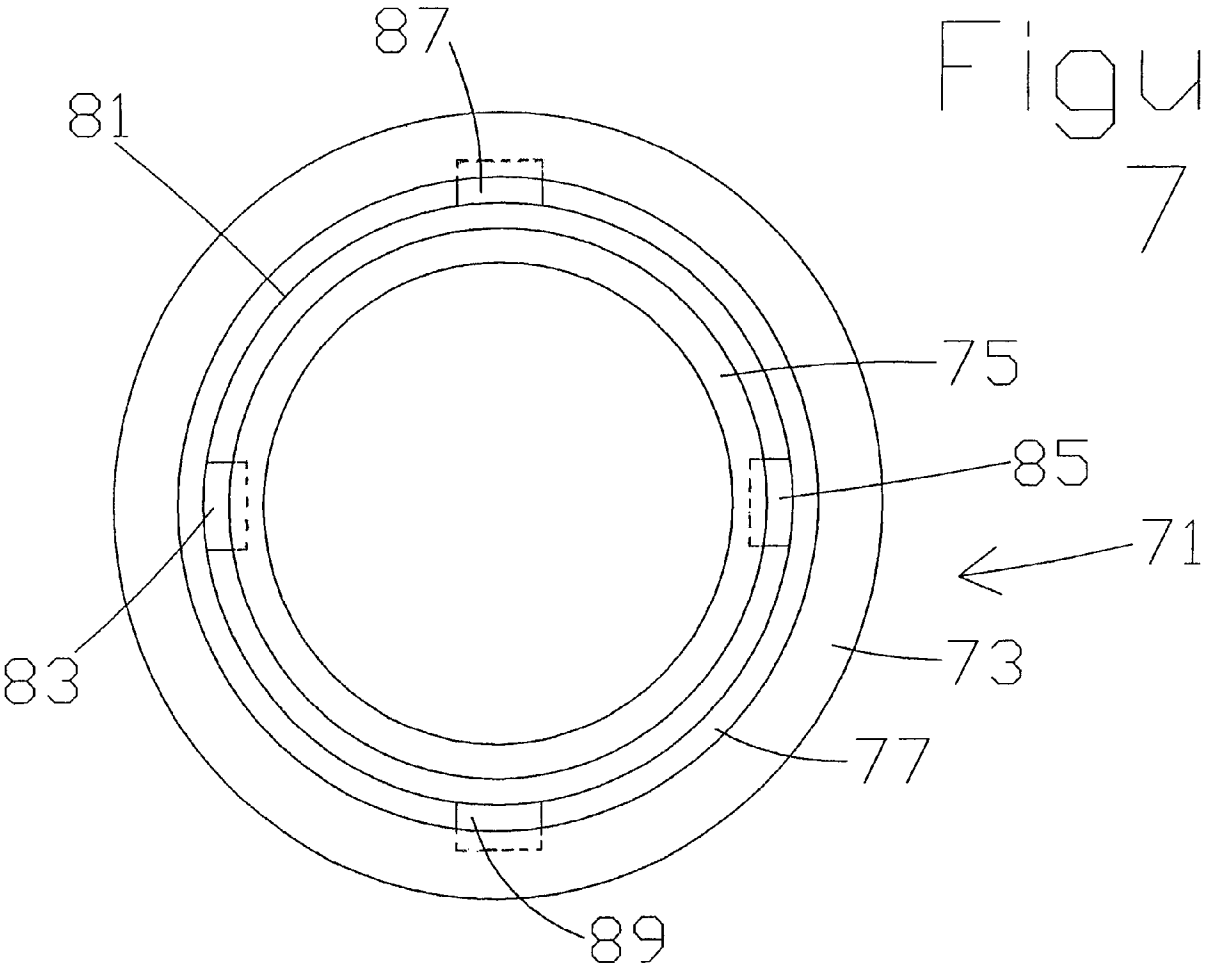
FIGS. 7, 8 and 9 show top, partial cut views with a present invention inner member and outer member interconnected, with a locked rest position shown in FIG. 7 and an unlocked, rail-squeezed flexed position shown in FIG. 8, and an unlocked, track-squeezed, flexed position shown in FIG. 9.
Figure 8:
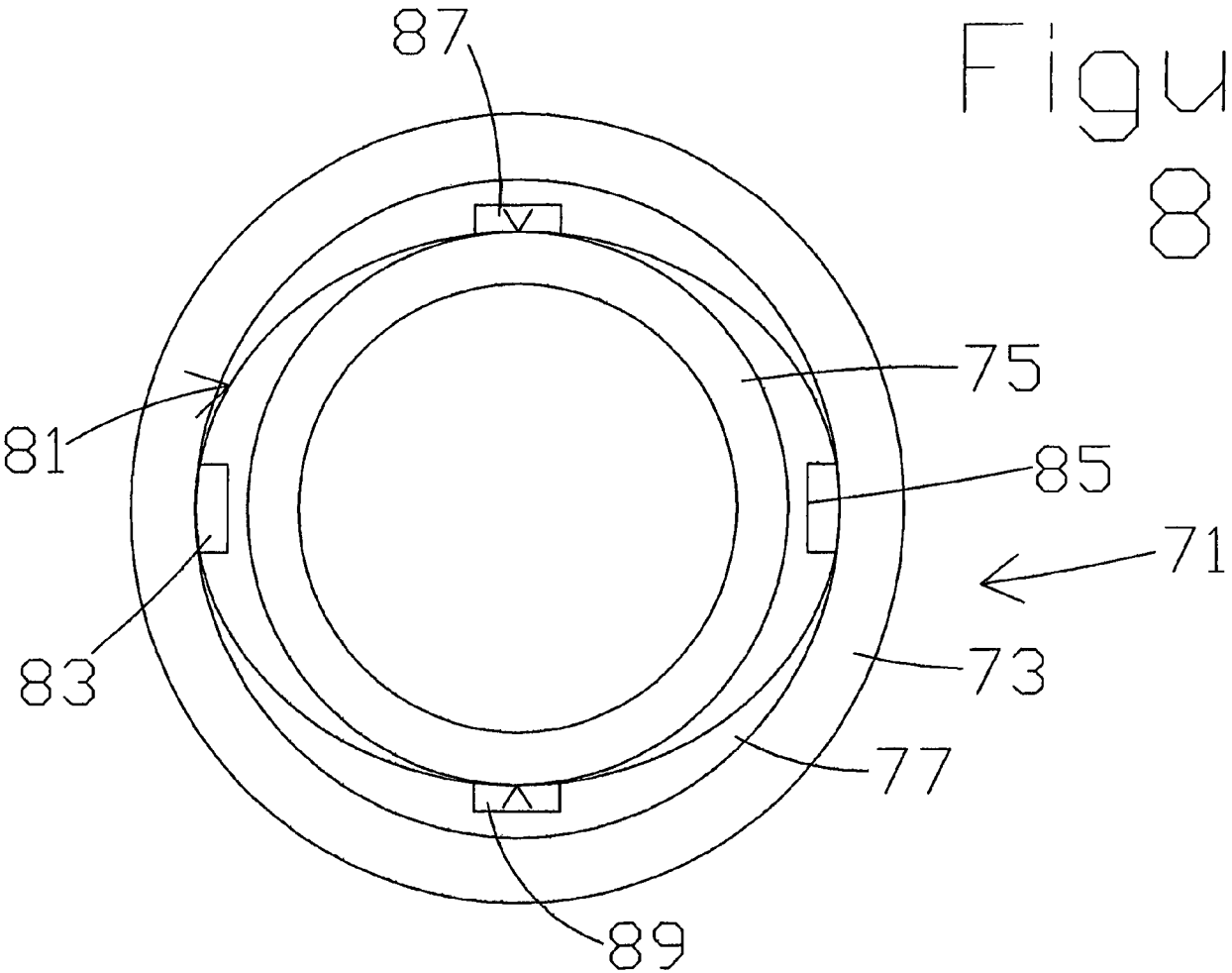
Figure 9:
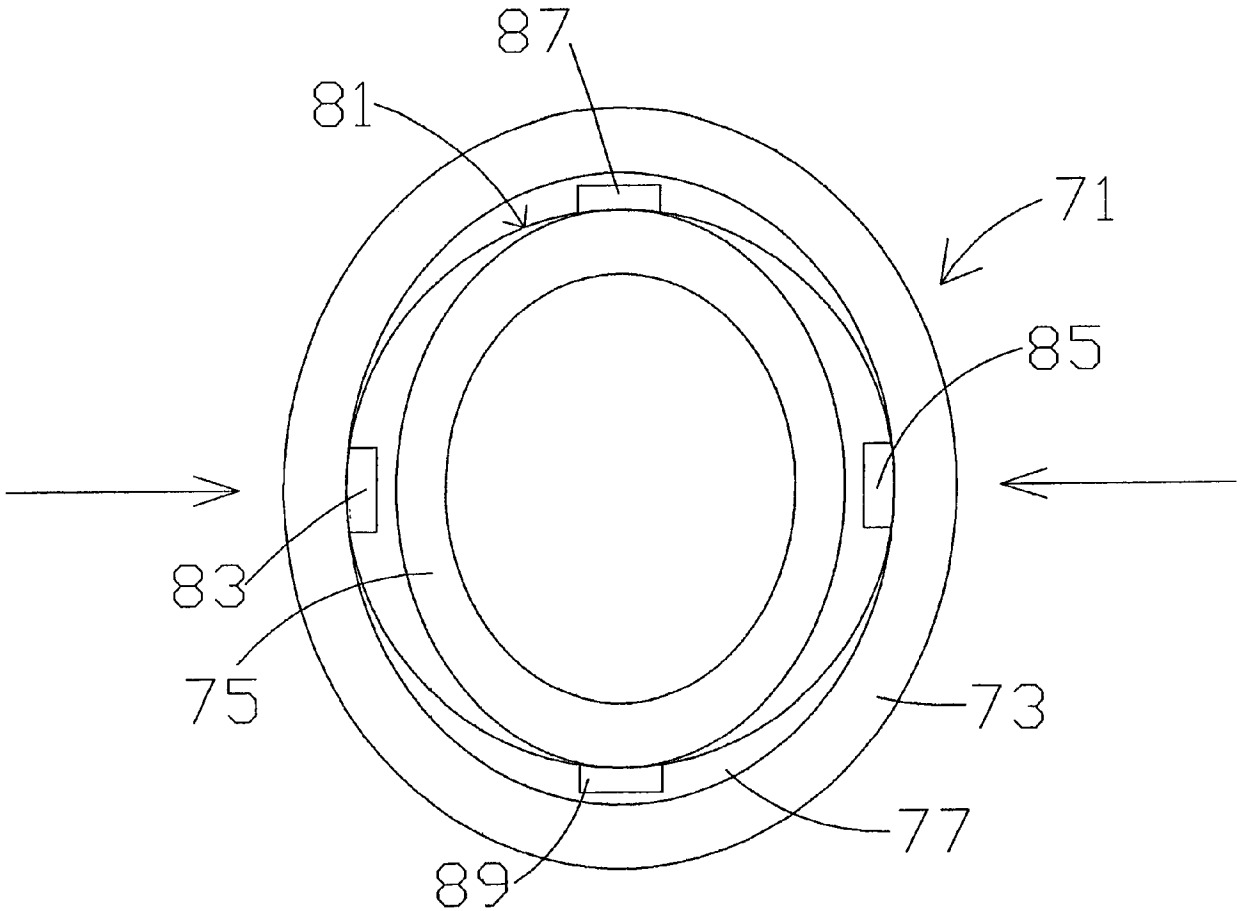

FIGS. 7, 8 and 9 show top, partial cut views with a present invention inner member 71 and outer member 81 interconnected, with a locked rest position shown in FIG. 7 and an unlocked, outer member (rail)-squeezed/flexed position shown in FIG. 8, and an unlocked, inner member (track)-squeezed/flexed position shown in FIG. 9. Inner member 71 is a track with an outside ledge 73 and an inside ledge 75 with a rail-receiving track space 77. Outer member 81 is a rail with a pair of inside protrusions 83 and 85 and a pair of outside protrusions 87 and 89. They are all symmetrical with respect to one another and are, therefore, evenly spaced. However, they could be slightly offset and still function in accordance with the present invention.

FIG. 7 shows that in its rest position (nothing squeezed or otherwise flexed), the inside protrusions 83 and 85 and the outside protrusions 87 and 89 are partially under the ledges 73 and 75 to as to inhibit lifting removal of the outer member 81 from the inner member 71. However, as shown in FIG. 8, if a user squeezes outer member 81 at indicia (not shown) above outside protrusions 87 and 89, this distorts the shape of outer member 81 into an oval so as to move outside protrusions 87 and 89 inwardly and inside protrusions 83 and 85 outwardly, so that they all will clear the track ledges 73 and 75 and can be removed from inner member 71 to then permit the user access to the container. Likewise, FIG. 9 shows the same device with inner member 71 and outer member 81, but with a different squeezing concept. Here, the user squeezes inner member 71 instead of outer member 81 to achieve the same relative positions of the rail protrusions and the track, for release of the outer member 81 from the inner member 71. It should now be recognized that either the inner member 71 or the outer member 81 or both of these may be semi-flexible enough to shift the protrusions into a release position. In addition, the invention may be embodied by products wherein the track is on the inner member 71 and the rail is on the outer member 81, or wherein the track is on the outer member 81 and the rail is on the inner member 71. The following figures further illustrate this point and other possible variations.

Figure 10:
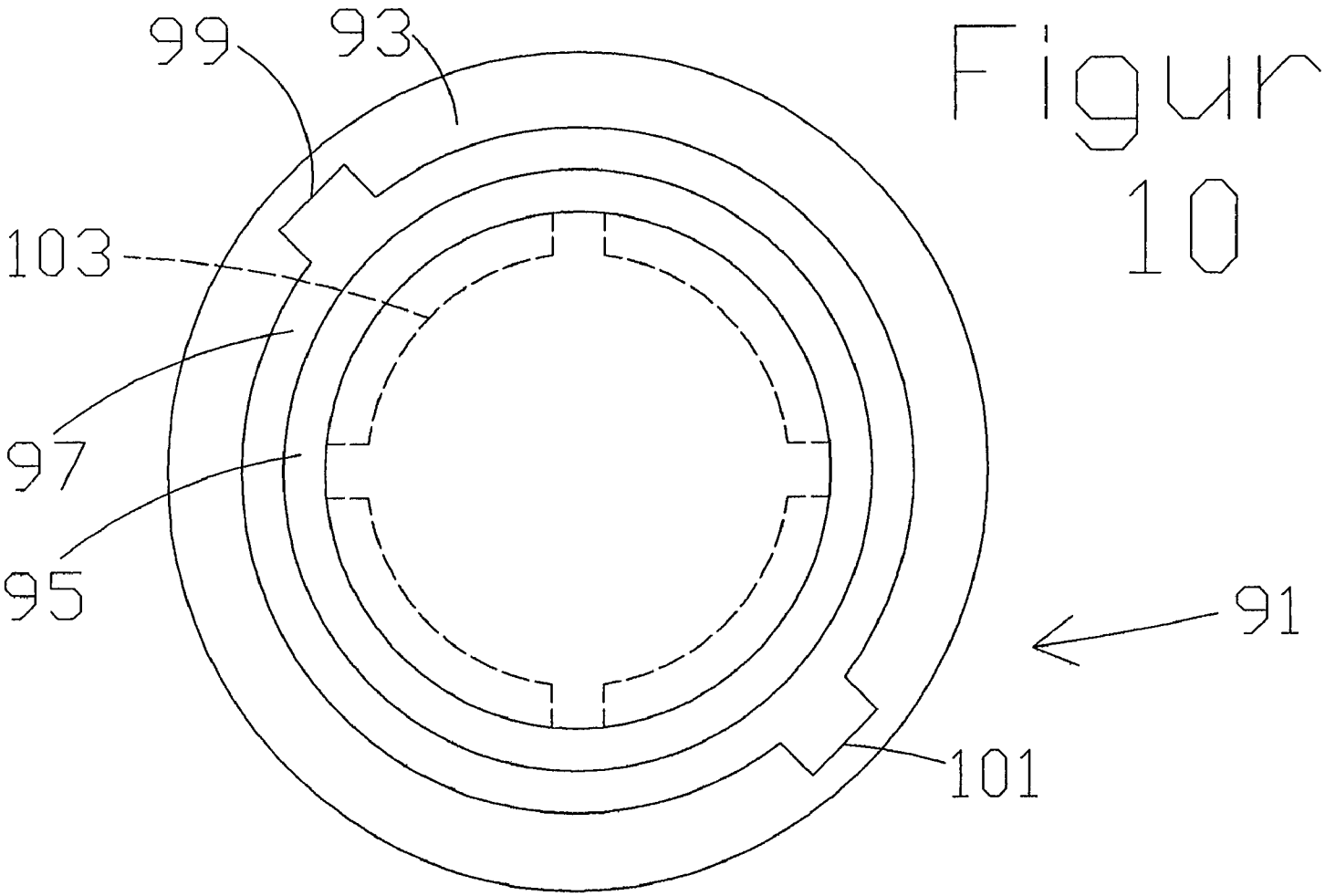
FIG. 10 shows a top view of another version of a present invention outer member or inner member track, but with outside ledge cutouts.

FIG. 10 shows a top view of another version of a present invention outer member or inner member track 91 which may face up on an inside member or face down on an outside member. Track 91 includes outside ledge 93 and inside ledge 95. Between these track ledges 93 and 95 is a track space 97 that permits insertion of a rail of the other member (not shown) to be snapped into track 91. (If track 91 were an inner member, it would also have attachment means for attachment to container, such as flange 103. If track 91 were and outer member, it would have a slid or closed top.) Outside ledge 93 has two cutouts 99 and 101 which only allow the other member to be inserted when proper alignment is achieved. In this version of the invention, the rail outside protrusions have a width sufficiently greater than half the width of track space 97 such that the outside protrusions, even when squeezed and flexed, need to be in alignment with cutouts 99 and 101 to be removed. This requires two indicia (not shown), one on the outer member and the other on the inner member that must be aligned in order to align the protrusions with the cutouts prior to squeezing for opening.

Figure 11:
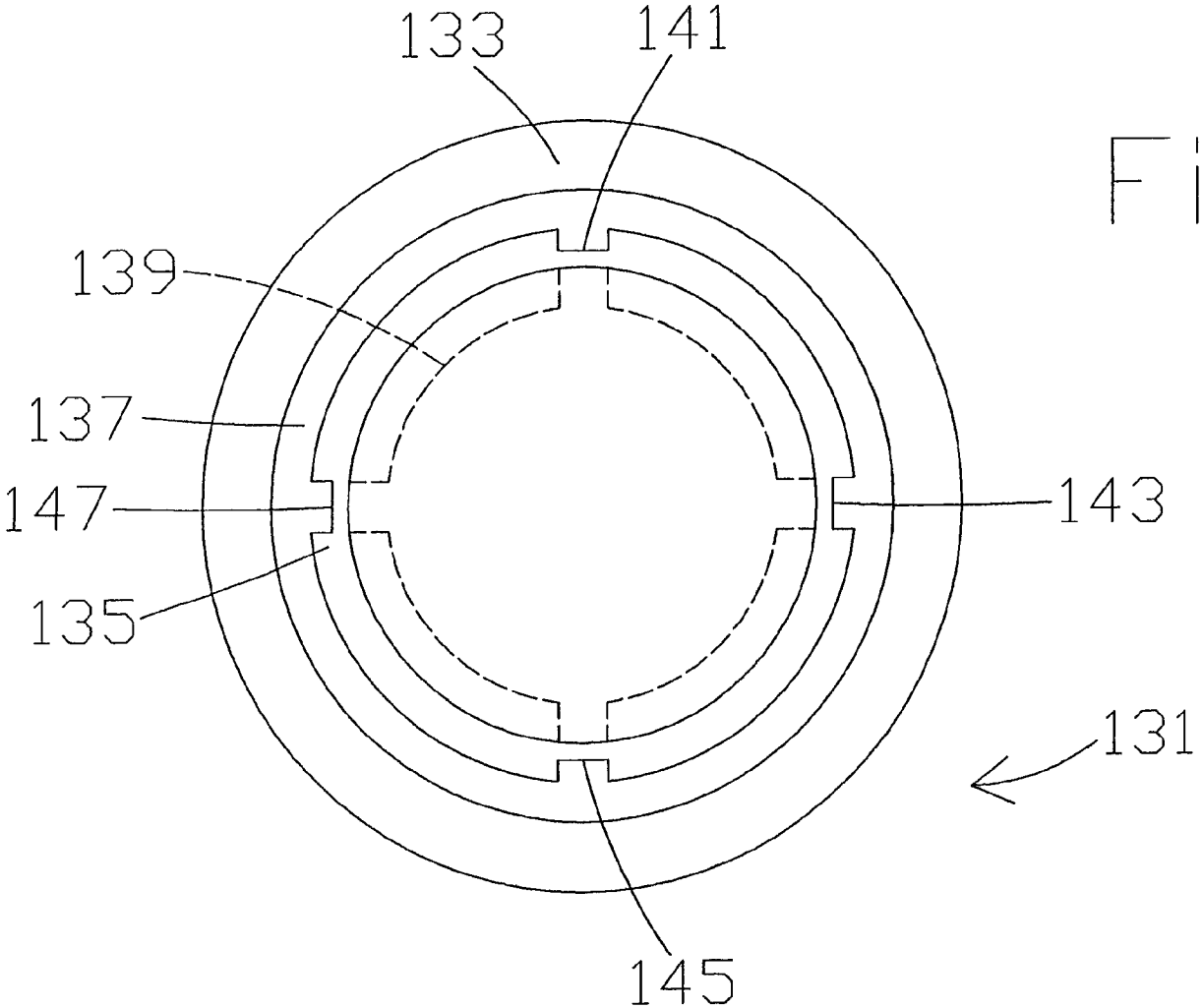
FIG. 11 shows a top view of another version of a present invention outer member or inner member track, but with inside ledge cutouts.

FIG. 11 also shows a top view of another version of a present invention outer member or inner member track 131. The track 131 may be located on the inner member or on the outer member, e. g., this may face up on an inside member or face down on an outside member. Track 131 includes an outside ledge 133 and inside ledge 135. Between these track ledges 133 and 135 is a track space 137 that permits insertion of a rail of the other member (not shown) to be snapped into track 131. (If track 131 were an inner member, it would also have attachment means for attachment to a container, such as flange 139. If track 131 were and outer member, it would have a slid or closed top.) This figure also illustrates another important variation of the present invention, namely, its inside ledge 135 has cutouts 141, 143, 145 and 147 for alignment. In this embodiment of the present invention, the rail inside protrusions have a width sufficiently greater than half the width of track space 137 such that the inside protrusions, even when squeezed and flexed, need to be in alignment with cutouts 141, 143, 145 and 147 to be removed. This requires two indicia, one on the outer member and the other on the inner member, that must be aligned to align the protrusions with the cutouts prior to squeezing, for opening. In this embodiment, the alignment would render four inside protrusions releasable and the squeezing would shift other protrusions to releasable positions.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A rotate, squeeze and lift child resistant safety cap with a dispenser actuator for attachment to a pressurized container having a dispenser stem on its top, comprising:

a) an inner member having attachment means for attachment to a pressurized container having a container top with a dispenser or stem on said container top, said inner member having an outer member interlocking component, being one of a circular track and a circular rail, said circular track having inside and outside ledges with a track space between said inside and outside ledges, said track space having a predetermined track space width, said circular rail having inside and outside protrusions adapted to ride inside said track space and under said ledges, said protrusions having widths greater than one half said track space width;

b) a dispenser actuator member having a base and a stem pipe, said stem pipe being adapted to fit over said dispenser stem of said pressurized container, said dispenser actuator member being hingedly attached to said inner member;

c) an outer member being an outer closure having a circular bottom that is semi-flexible, and at its circular bottom, having the other of said one of a circular track and a circular rail, said circular track having inside and outside ledges with a track space between said inside and outside ledges, said track space having a predetermined track space width, said circular rail having inside and outside protrusions adapted to ride within said track space and under said ledges, said protrusions having widths greater than one half said track space width, and having squeeze indicia above said outside protrusions, said outer member having an open interior adapted to fit over said dispenser actuator member;

wherein, when said inner member is attached to said pressurized container and said inner member and said outer member are interconnected, a user cannot lift said outer member from said inner member nor lift said inner member from said container so that access to said dispenser actuator members is denied, except, if a user squeezes said outer member at said squeeze indicia to flex said outer member from circular to oval, said outside protrusions will position inwardly to clear said ledges and said inside protrusions will position outwardly to clear said ledges so as to enable lift removal of said outer member from said inner member to expose dispenser actuator member for activation to dispense contents of said pressurized container.

2. The rotate, squeeze and lift child resistant safety cap with a dispenser actuator for attachment to a pressurized container having a dispenser stem on its top according to claim 1, wherein said dispenser actuator member includes a depression pad attached to at least one of said dispenser actuator member base and said dispenser actuator member dispenser stem.

3. The rotate, squeeze and lift child resistant safety cap with a dispenser actuator for attachment to a pressurized container having a dispenser stem on its top according to claim 1, wherein said inner member, said dispenser actuator member and said outer member are circular from a top view.

4. The rotate, squeeze and lift child resistant safety cap with a dispenser actuator for attachment to a pressurized container having a dispenser stem on its top according to claim 1, wherein there are two outside protrusions and two inside protrusions.

5. The rotate, squeeze and lift child resistant safety cap with a dispenser actuator for attachment to a pressurized container having a dispenser stem on its top according to claim 1, wherein said protrusions are spaced equally apart from one another.

6. The rotate, squeeze and lift child resistant safety cap with a dispenser actuator for attachment to a pressurized container having a dispenser stem on its top according to claim 1, wherein said attachment means is a riser and an inwardly projecting clamping component.

7. The rotate, squeeze and lift child resistant safety cap with a dispenser actuator for attachment to a pressurized container having a dispenser stem on its top according to claim 1, wherein one of said ledges includes cutouts corresponding to at least one of said inside protrusions and said outside protrusions and both said inner member and said outer member have alignment means for rotation and alignment with one another to align said cutouts with their corresponding protrusions so as to clear at least one but not all of said protrusions prior to squeezing for lifting said outer member from said inner member.

8. The rotate, squeeze and lift child resistant safety cap with a dispenser actuator for attachment to a pressurized container having a dispenser stem on its top according to claim 7, wherein said cutouts are located on said inside ledge and correspond to said inside protrusions.

9. The rotate, squeeze and lift child resistant safety cap with a dispenser actuator for attachment to a pressurized container having a dispenser stem on its top according to claim 7, wherein said cutouts are located on said outside ledge and correspond to said outside protrusions.

10. The rotate, squeeze and lift child resistant safety cap with a dispenser actuator for attachment to a pressurized container having a dispenser stem on its top according to claim 7, wherein at least one of said cutouts is located on said inside ledge and corresponds to at least one of said inside protrusions and wherein at least one of said cutouts is located on said outside ledge and corresponds to at least one of said outside protrusions.

11. A rotate, squeeze and lift child resistant safety cap with a dispenser actuator for attachment to a pressurized container having a dispenser stem on its top, comprising:

a) an inner member having attachment means for attachment to a pressurized container having a container top with a dispenser or stem on said container top, said inner member having an outer member interlocking component, being one of a circular track and a circular rail, said circular track having inside and outside ledges with a track space between said inside and outside ledges, said track space having a predetermined track space width, said circular rail having inside and outside protrusions adapted to ride inside said track space and under said ledges, said protrusions having widths greater than one half said track space width;

b) a dispenser actuator member having a base and a stem pipe, said stem pipe being adapted to fit over said dispenser stem of said pressurized container, said dispenser actuator member being hingedly attached to said inner member, said dispenser actuator member and said inner member being a single unistructurally formed piece;

c) an outer member being an outer closure having a circular bottom that is semi-flexible, and at its circular bottom, having the other of said one of a circular track and a circular rail, said circular track having inside and outside ledges with a track space between said inside and outside ledges, said track space having a predetermined track space width, said circular rail having inside and outside protrusions adapted to ride within said track space and under said ledges, said protrusions having widths greater than one half said track space width, and having squeeze indicia above said outside protrusions, said outer member having an open interior adapted to fit over said dispenser actuator member;

wherein, when said inner member is attached to said pressurized container and said inner member and said outer member are interconnected, a user cannot lift said outer member from said inner member nor lift said inner member from said container so that access to said dispenser actuator members is denied, except, if a user squeezes said outer member at said squeeze indicia to flex said outer member from circular to oval, said outside protrusions will position inwardly to clear said ledges and said inside protrusions will position outwardly to clear said ledges so as to enable lift removal of said outer member from said inner member to expose dispenser actuator member for activation to dispense contents of said pressurized container.

12. The rotate, squeeze and lift child resistant safety cap with a dispenser actuator for attachment to a pressurized container having a dispenser stem on its top according to claim 11, wherein said dispenser actuator member includes a depression pad attached to at least one of said dispenser actuator member base and said dispenser actuator member dispenser stem.

13. The rotate, squeeze and lift child resistant safety cap with a dispenser actuator for attachment to a pressurized container having a dispenser stem on its top according to claim 11, wherein said inner member, said dispenser actuator member and said outer member are circular from a top view.

14. The rotate, squeeze and lift child resistant safety cap with a dispenser actuator for attachment to a pressurized container having a dispenser stem on its top according to claim 11, wherein there are two outside protrusions and two inside protrusions.

15. The rotate, squeeze and lift child resistant safety cap with a dispenser actuator for attachment to a pressurized container having a dispenser stem on its top according to claim 11, wherein said protrusions are spaced equally apart from one another.

16. The rotate, squeeze and lift child resistant safety cap with a dispenser actuator for attachment to a pressurized container having a dispenser stem on its top according to claim 11, wherein said attachment means is a riser and an inwardly projecting clamping component.

17. The rotate, squeeze and lift child resistant safety cap with a dispenser actuator for attachment to a pressurized container having a dispenser stem on its top according to claim 11, wherein one of said ledges includes cutouts corresponding to at least one of said inside protrusions and said outside protrusions and both said inner member and said outer member have alignment means for rotation and alignment with one another to align said cutouts with their corresponding protrusions so as to clear at least one but not all of said protrusions prior to squeezing for lifting said outer member from said inner member.

18. The rotate, squeeze and lift child resistant safety cap with a dispenser actuator for attachment to a pressurized container having a dispenser stem on its top according to claim 17, wherein said cutouts are located on said inside ledge and correspond to said inside protrusions.

19. The rotate, squeeze and lift child resistant safety cap with a dispenser actuator for attachment to a pressurized container having a dispenser stem on its top according to claim 17, wherein said cutouts are located on said outside ledge and correspond to said outside protrusions.

20. The rotate, squeeze and lift child resistant safety cap with a dispenser actuator for attachment to a pressurized container having a dispenser stem on its top according to claim 17, wherein at least one of said cutouts is located on said inside ledge and corresponds to at least one of said inside protrusions and wherein at least one of said cutouts is located on said outside ledge and corresponds to at least one of said outside protrusions.

* * * * *